US005349426A

United States Patent [19]

Kudoh et al.

[11] Patent Number: 5,349,426

[45] Date of Patent: Sep. 20, 1994

[54] TONER GUIDE ROLLER FOR IMAGE-FORMING PROCESS AND APPARATUS APPLIED THEREWITH

[75] Inventors: Koichi Kudoh; Eiichi Sakai; Yoshiaki Takei, all of Hachioji, Japan

[73] Assignee: Konica Corporation, Tokyo, Japan

[21] Appl. No.: 148,624

[22] Filed: Nov. 8, 1993

[30] Foreign Application Priority Data

Nov. 9, 1992 [JP] Japan ..... 4-298913
Jan. 20, 1993 [JP] Japan ..... 5-007787

[51] Int. Cl.[5] ..... G03G 21/00

[52] U.S. Cl. ..... 355/298; 355/297; 118/652; 430/125

[58] Field of Search ..... 355/298, 297, 299, 296; 118/652; 15/256.5, 256.51, 256.52; 430/125

[56] References Cited

U.S. PATENT DOCUMENTS 3,871,762 3/1975 Van Der Vlasakker .
4,323,306 4/1982 Ito et al. .
4,739,370 4/1988 Yoshida ..... 118/652 X
5,148,227 9/1992 Senba ..... 355/296

FOREIGN PATENT DOCUMENTS 60-107675 6/1985 Japan .
61-67073 4/1986 Japan .
1-267679 10/1989 Japan .

OTHER PUBLICATIONS

Japanese Published Utility Model Application No. 57-172470/1982.
English Abstract of Japanese Patent Document 1-267680, Document Publication Date Oct. 25, 1989.
Communication of European Search Report for Application No. EP 93118148, dated Mar. 2, 1994.

*Primary Examiner*—R. L. Moses
*Attorney, Agent, or Firm*—Finnegan, Henderson, Farabow, Garrett & Dunner

[57] ABSTRACT

An image forming apparatus, such as a copier and a printer, for forming a toner image on a recording sheet. The apparatus includes: a photoreceptor for holding the toner image; an image exposure driver for forming a latent image on the photoreceptor; a developer for developing the latent image with a toner so that the toner image is formed on the surface of the photoreceptor; a transferrer for transferring the toner image from the surface of the photoreceptor to the recording sheet; a scraping blade for scraping off a residual toner on the surface of the photoreceptor after the toner image is transferred from the surface to the recording sheet; a toner collection chanber for collecting the residual toner; a toner guide roller for conveying the residual toner from the scraping blade to the toner collecting chanber; in which the toner guide roller is urged onto the surface of the photoreceptor, and the toner guide roller has a surface made of an open-cell cellular material having a pore size between 1 μm and 50 μm.

19 Claims, 5 Drawing Sheets

TONER GUIDE ROLLER FOR IMAGE-FORMING PROCESS AND APPARATUS APPLIED THEREWITH

BACKGROUND OF THE INVENTION

This invention relates to an improved cleaning means for an electrophotographic copier or a printer and an image-forming process and image-forming apparatus each in which the cleaning means is used.

Heretofore in the electrophotography based on Carlson process, an image is formed in the following manner. A uniform charge is applied to the surface of an image-forming member; an electrostatic latent image is formed by making an imagewise exposure; a toner image is formed by developing the latent image; and the toner image is transferred and fixed to an image transfer member.

After making the image transfer, the image-forming member is cleaned up by a cleaning means and is then used repeatedly for a long time. It is inevitable for the cleaning step to have both of a cleaning function by which toner remaining on an image-forming member is effectively scraped away by a cleaning means such as a cleaning blade, and a toner collecting function by which cleaned up toner is smoothly collected on the outside of an image-forming region by a collecting means such as a cleaning roller. When the two functions are fulfilled satisfactory, an excellent cleaning operation can be performed.

According to the studies through many years made by the inventors, a toner guide roller is required to satisfy the following peculiar requirements to fully perform the functions.

To be more concrete, it is required to satisfy the following requirements:

(1) A guide roller itself is great in durability, strong in mechanical abrasion resistance and resistant to the functions of activator such as ozone produced by a discharge, because the roller is relatively close to a corona discharge electrode;

(2) When the guide roller is rotated by coupling it to the rotation of an image-forming member, the roller is well followed around the image-forming member without any slipping off of the rotation and any erroneous rotation is not produced even when the roller is forcibly rotated;

(3) Toner scraped off from the image-forming member adheres to the guide roller surface so that the toner can smoothly be transported, and the roller is excellent in toner transportability and in separability of the adhered toner from the roller, because the adhered toner is to be collected smoothly by a scraper;

(4) The guide roller surface has a proper elasticity and is brought into close contact with the surface of the image-forming member without any gap so that the roller can be rotated without producing any toner scattering;

(5) When the guide roller is rotated, the image-forming member surface can neither abraded nor damaged; and (6) In an image transfer step, the roller is to be efficiency in removal of paper dust.

For the techniques in which toner scraped off from the surface of an image-forming member by a cleaning means such as a cleaning blade and an elastic roller is collected by the above-mentioned elastic roller, there are some proposals therefor such as those disclosed in Japanese Patent Publication Open to Public Inspection (hereinafter referred to as JP OPI Publication) Nos. 60-107675/1985, 61-67073/1986 and 1-267679/1989. Wherein an elastic roller comprising a foamed material such as urethane rubber, chloroprene rubber, silicone rubber and sponge is served as both a cleaning means together with a cleaning blade and a toner guide roller, such elastic roller is rotated by bringing it into pressure contact with an image-forming member so that cleaned up toner scraped off by the cleaning means is made adhered to the guide roller and is then transported by the guide roller to a toner collection unit.

The above-mentioned foamed material such as sponge herein means that it has a pore size of not smaller than 100 μm and it is quite different in itself from the open-cell cellular materials of the invention.

However, the guide rollers described in the above-mentioned patent publications cannot satisfy all the requirements (1) through (6). In the present state where a high-speed operation and a high image quality are recently demanded on copying machines, most of the above-mentioned requirements have not been satisfied and the improvements of the guide roller have also been urgently needed.

For example, Japanese Utility Model Publication Open to Public Inspection No. 57-172470/1982 proposes for an elastic roller having at least the surface comprising an open-cell cellular material to serve as a cleaning means in place of the above-mentioned cleaning blade for a copying machine. Wherein cleaned up toner is collected by a suction fan.

The elastic roller described therein is strictly a cleaning means for an image-forming member and remaining toner is required to be scraped off at a high rotation speed. It is therefore difficult to select a peculiar cellular material to meet the requirement. There are some problems that the size of a cleaning unit becomes remarkably larger than in the other image-forming apparatuses, that a noise is produced and that a cleaning effect becomes more unsatisfactory than in a cleaning blade.

It is an object of the invention to provide a toner guide roller by which toner scraped off by a cleaning blade is made adhered to and then transported to a collection member efficiently and fully.

Another object of the invention is to provide a toner cleaning device, an image-forming process and an image-forming apparatus each in which a toner cleaning property is excellent in a process of repeatedly forming images and, particularly, an image is not deteriorated by the surface of an image-forming member damaged by a toner guide roller so that a high quality image can stably be obtained.

SUMMARY OF THE INVENTION

The above-mentioned objects of the invention can be achieved with a toner guide roller at least having the surface comprising an open-cell cellular material of a certain pore size.

The above-mentioned objects of the invention can be achieved with an image-forming process comprising the steps of developing an electrostatic latent image produced on an image-forming member, forming a toner image therefrom, transferring the toner image to an image transfer member and carrying out a step of cleaning toner remaining on the image-forming member by a toner cleaning means; wherein the toner cleaning means is a toner cleaning blade and the toner cleaned up by the toner cleaning blade is guided and then transported to a toner collection member by a toner guide roller having at least the surface comprising an open-cell cellular material of a certain pore size.

The above-mentioned objects of the invention can also be achieved with an image-forming apparatus by which an electrostatic latent image produced on an image-forming member is developed to form a toner image therefrom and the toner image is transferred to an image transfer member and then toner remaining on the image-forming member is cleaned up by a toner cleaning means; wherein the toner cleaning means is a toner cleaning blade, a toner guide roller is so provided as to guide and transport the toner cleaned up on the upstream side of the blade to a toner collection member and the toner guide roller has at least the surface comprising an open-cell cellular material of a certain pore size.

The above-mentioned objects of the invention can further be achieved with a toner guide roller comprising at least a conductive open-cell cellular material of a certain pore size selected from the above-mentioned constitution of the invention.

The above-mentioned objects of the invention can still further be achieved with an image-forming process comprising the steps of developing an electrostatic latent image produced on an image-forming member, forming a toner image therefrom, transferring the toner image to an image transfer member and carrying out a step of cleaning toner remaining on the image-collection forming member by a toner cleaning means; wherein the toner cleaning blade is used as a toner cleaning means and the toner cleaned up by the toner cleaning blade is guided and then transported to a toner collection member by a toner guide roller having at least the surface comprising a conductive open-cell cellular material of a certain pore size.

The above-mentioned objects of the invention can again be achieved with an image-forming apparatus by which an electrostatic latent image produced on an image-forming member is developed to form a toner image therefrom and the toner image is transferred to an image transfer member and then toner remaining on the image-forming member is cleaned up by a toner cleaning means; wherein the toner cleaning means is a toner cleaning blade, a toner guide roller is so provided as to guide and transport the toner cleaned up on the upstream side of the blade to a toner collection member and the toner guide roller has at least the surface comprising a conductive open-cell cellular material of a certain pore size.

The above-mentioned objects of the invention can over again be achieved with an image-forming process comprising the steps of developing an electrostatic latent image formed on an image-forming member having other constitution selected from the constitution of the invention, forming a toner image therefrom, transferring the toner image to an image transfer member and then carrying out a step of cleaning toner remaining on the image-forming member by a cleaning means; wherein a cleaning blade is used as the cleaning means, an organic photoreceptor is used as the image-forming member so as to have at least the surface layer thereof containing polycarbonate or a copolymer containing a component unit of polycarbonate as a binder resin, and the toner cleaned up by the blade is guided and then transported to a toner collection member by a toner guide roller having at least the surface comprising an open-cell cellular material of a certain pore size.

The above-mentioned objects of the invention can further be achieved with an image-forming apparatus by which an electrostatic latent image produced on an image-forming member is developed to form a toner image therefrom and the toner image is transferred to an image transfer member and then toner remaining on the image-forming member is cleaned up by a toner cleaning means; wherein the image-forming member is an organic photoreceptor having at least the surface layer containing polycarbonate as a binder resin or a copolymer containing a polycarbonate component unit as a component of the copolymer, the toner cleaning means is a toner cleaning blade, a toner guide roller is so provided as to guide and transport the toner cleaned up on the upstream side of the blade to a toner collection member and the toner guide roller has at least the surface comprising an open-cell cellular material of a certain pore size.

DETAILED DESCRIPTION OF THE INVENTION

Figure 1:
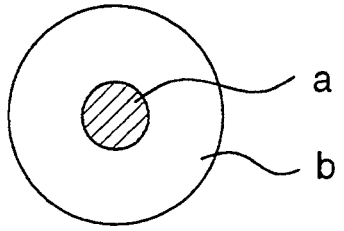
FIGS. 1(*a*) and 1(*b*) are cross-sectional views of an example of the toner guide rollers of the invention.
Figure 1:
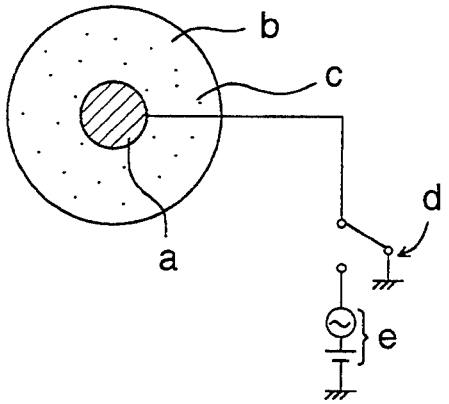

After completing an image transfer, toner remaining on the image-forming member is scraped off and cleaned up by a cleaning means and, particularly, a cleaning blade provided to the downstream side of the image-forming member rotating direction, the toner guide roller of the invention is to make the scraped off and cleaned up toner adhered and transported to a toner collection member so that the transported toner can smoothly be collected. As described above, the guide roller is therefore required to have the peculiar properties such as the rotatability coupled to that of an image-forming member, the adhesion to, transportability of and separability from cleaned up toner, and a proper elasticity.

For satisfying the above-mentioned properties in the invention, a guide roller having at least the surface comprising an open-cell cellular material of a certain pore size is used. The open-cell cellular material is mainly comprised of a macromolecular material such as polyurethane, chloroprene, nitrile-butadiene and silicone. It is also allowed to use a macromolecular material such as polyvinyl chloride, polyethylene and fluororesin. It is, however, preferable to use the polyurethane for the toner guide roller of the invention.

The method for preparing the open-cell cellular material is described in, for example, JP OPI Publication No. 58-189242/1983.

The open-cell cellular material is prepared in the following method. A macromolecular polymer such as polyurethane is dissolved in an organic solvent. The resulting solution is added with a cellular material such as polyvinyl alcohol, alginic acid and calcium sulfate. The mixture thereof is stirred and then defoamed. The resulting solution is put into a cellular vessel and is then dipped for a long time in a warm bath having a temperature of about 50° C. so as to be gelled. The resulting gel is taken out thereof and the cellular material is dissolved out, heated and then dried. Thereby a cellular material having a number of continuous pores is formed, so that a toner guide roller can be provided with the inevitably excellent properties such as an antiabrasion property, a toner separability, a toner transportability, a contact-rotation property to a photoreceptor, an elasticity and a paper dust removing property.

In contrast to the above, the conventional method for preparing a closed-cell cellular material is to add with, for example, a polyol or isocyanate compound, a reaction accelerator and a foam controller and is to be stirred and foamed so that the foamed material is so heated as to be prepared. Therefore, a number of closed-cell cellular materials are integrated together.

The term, a closed-cell cellular material, stated herein, shall not be limited to those having a quite independent pore, but shall include those having continuous pores. Most of the closed-cell cellular materials are each comprised of independent pores distinguished from each other and the pore size thereof is relatively larger. The method for preparing the closed-cell cellular materials is quite different as described above.

Such a closed-cell cellular material as mentioned above has an elasticity to function as a cushion, but it is poor in abrasion resistance, toner separability, toner transportability, contact-rotatability to a photoreceptor and paper-dust removability and not satisfactory in flexibility. For providing a satisfactory flexibility to a closed-cell cellular material, the pores of the cellular material is required to make it larger. In this case, there produces such a trouble that various properties of the cellular material become unsatisfactory to use it as a toner guide roller, that the durability of itself is deteriorated and, in addition, that toner is filled in the pores and, even after the toner remaining on the surface of a roller is scraped off by a scraper, the roller is rotated downward as the pores are containing the toner, so that the toner drops to the inside of a copying machine to get dirt therein.

In the invention, the above-mentioned troubles can be remedies by making use of an open-cell cellular material having a number of fine pores in a certain pore size, which is excellent in flexibility, various properties and durability and, at the same time, a toner guide roller having an outstanding aptitude can be provided.

As for the preferable properties required of an open-cell cellular material of a certain pore size applicable to a toner guide roller of the invention, the pore size of the cellular material is within the range of 1 to 50 μm and, preferably, 5 to 20 μm. When the pore size thereof is smaller than 1 μm, the flexibility of the toner guide roller is lowered to cause the cost of cellular material too high. When the pore size thereof is larger than 50 μm, the durability of the roller may also be deteriorated, and the pores are filled with the toner to cause a toner be scattered too much. Especially, the pore size of the ordinal sponge is more than 100 μm and such the material is not applicable to the toner guide roller of the image forming apparatus because of the above stated disadvantages.

The porosity of the cellular material is within the range of 50 to 90% and, preferably, 60 to 80%. When the porosity thereof is lower than 50%, the elasticity thereof is lowered to make the cellular material too hard, so that an image-forming member may be damaged and the cellular material can hardly be prepared. When the porosity thereof is higher than 90%, the deformation rate thereof becomes large and, when a storage under pressure is made longer, a permanent deformation may be produced and, when rotating the roller, a toner may be scattered too much. Further, the durability of the roller may also be deteriorated.

The specific gravity thereof is to be within the range of 0.1 to 0.4 and, preferably, 0.15 to 0.38. When it is lower than 0.1, a large deformation, a permanent deformation and a poor durability may be produced. When it is higher than 0.4, the elasticity may become poor and the hardness may also become increased, so that an image-forming member may be damaged.

The Asuka C hardness thereof is to be within the range of 15 to 50 and, preferably, 20 to 45. When the Asuka C hardness is lower than 15, the guide roller may become so soft that an erratic rotation may be produced, that a scraper may not satisfactorily scrape toner and that the durability may be deteriorated. When it is higher than 50, the hardness is so high that an image-forming member may be so damaged as to shorten the life of the image-forming member.

The Asuka C hardness is measured by the Asuka C test. As shown in FIGS. 7(*a*) through 7(*d*), Asuka C test is executed with the instrument regulated by the regulations shown in Table A. However, for the test, the instrument is applied to the object until the object is in contact with the pressure surface, and the indicator is read.

Since the pressure needle of the instrument is protruded 2.54 mm from the pressure surface, if the object has an elasticity not less than the maximum elasticity of the test, the needle is pushed into the instrument completely by the object so that the indicator indicates 100°. Otherwise, the indicator displays the hardness of the object according to the elasticity of the object with a number between 0° and 100°.

TABLE A

| | NEEDLE SIZE | | | |
|---|---|---|---|---|
| | MAXIMUM | FIGURE OF | SPRING LOAD | |
| TEST | HEIGHT | NEEDLE | AT 0° | AT 100° |
| ASUKA C | 2.54 mm | FIG. 7 | 55 g | 855 g |

With an open-cell cellular material applicable to a toner guide roller of the invention, the pore size for specifying the properties thereof shall be measured in conformity with the provision specified in JIS K6402. The porosity $\rho$ shall be measured in terms of a percentage of a pore volume to the whole volume of the cellular material and the measurement thereof shall be calculated out in the following formula.

$$\rho(\%)=(W_1-W_2)/(W_1-W_3)\times 100$$

wherein $W_1$: Weight of the cellular material when water was sucked;

$W_2$: Weight of the cellular material when it is dried;

$W_3$: Weight of the cellular material when it is dipped in water;

The specific gravity of an open-cell cellular material shall be measured in conformity with the provision of ASTM D-2406. (The specific gravity is herein represented by an apparent specific gravity.)

In a cleaning device relating to the invention, a cleaning blade having such a simple structure as mentioned above and an excellent cleaning property and a toner guide roller comprising an open-cell cellular material having a particularly excellent toner guiding property are integrated in a body. Thereby, the cleaning device can be made compact and a satisfactory cleaning function and a toner collecting function can also be attained, so that a high image quality can also stably be provided when images are repeatedly formed for a long time.

An example of the toner guide rollers preferred for the invention is given in FIG. 1(*a*), wherein (*a*) indicates a core bar and (*b*) indicates a roller member comprising an open-cell cellular material.

FIGS. 2, 3, 4 and 5 illustrate each an example of an image-forming apparatus provided with a cleaning device integrated with a cleaning blade and the above-mentioned guide roller of the invention inside a casing.

Figure 2:
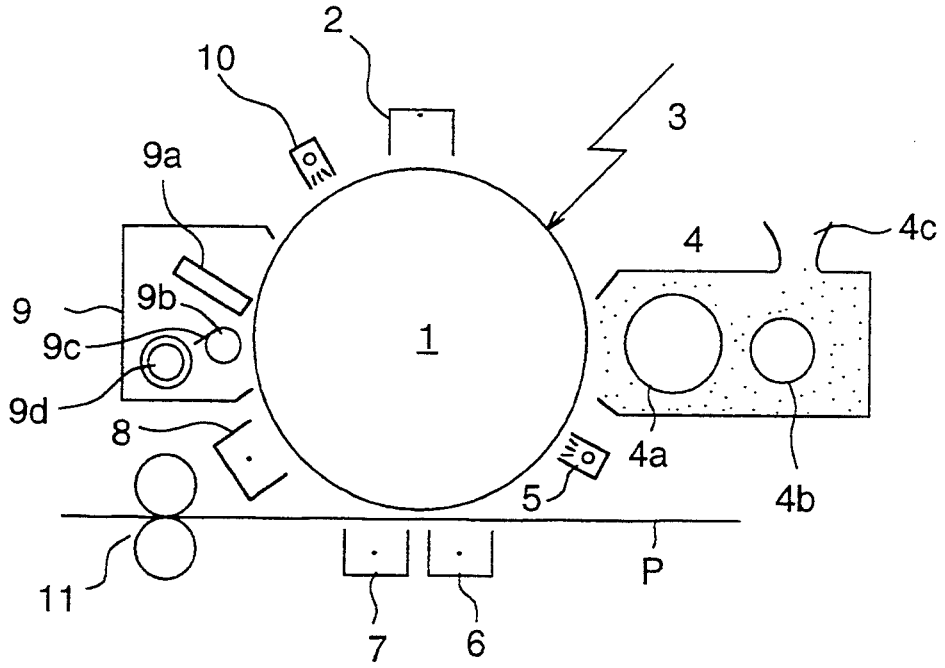
FIG. 2 is a schematic cross-sectional view of an image-forming apparatus of the invention.

FIG. 2 illustrates a cross-sectional view of an image-forming apparatus, wherein 1 is a photoreceptor for an image-forming member, on which a uniform charge is applied by charger 2, so that an electrostatic latent image is formed by making imagewise exposure 3. The resulting electrostatic latent image is developed by developing unit 4 to form a toner image. If required, the toner image is made ready to be transferred by pre-transfer exposure lamp 5 and is then transferred to image transfer paper P conveyed from a paper feeding device. The image-transferred paper is separated from the photoreceptor and is then transported to fixing device 11 by a transport member, so that the image is fixed thereon. On the other hand, the photoreceptor after completing the image transfer is cleaned up by blade 9*a* of cleaning device 9.

The cleaned up toner is made adhered to toner guide roller 9*b* of the invention and is then transported by the toner guide roller to be collected in collection member 9*d* through scraper 9*c*.

Photoreceptor 1 to be incorporated in the image-forming apparatus may be an inorganic photoreceptor provided with an inorganic photoconductive layer such as those made of selenium and amorphous silicon to the conductive drum thereof such as that made of a metal and, preferably, an organic photoreceptor provided with an organic photoconductive layer. In the case of an organic photoreceptor, the effects of a toner guide roller having the surface thereof comprising the above-mentioned open-cell cellular material of the invention can more remarkably be displayed. Although a photoreceptive layer is regarded as it is relatively soft, cleaned up toner may be transported and collected smoothly without abrading or damaging the photoreceptive layer.

Figure 3:
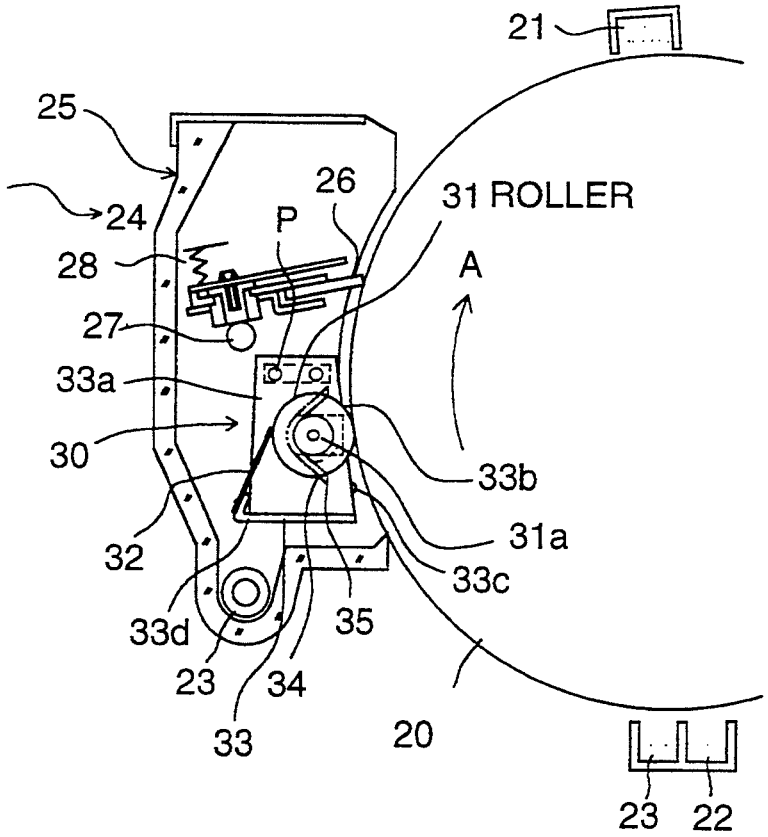
FIG. 3 is a cross-sectional view of an example of the cleaning devices each having a guide roller of the invention.
Figure 4:
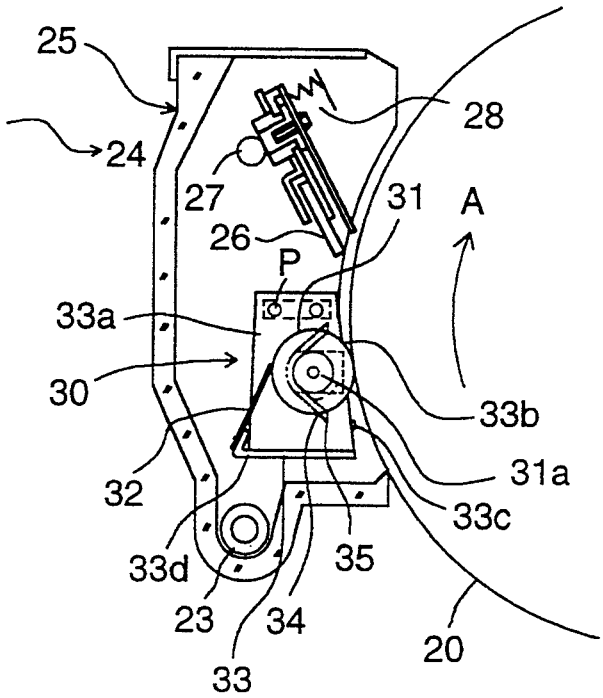
FIG. 4 is a cross-sectional view of another example of the cleaning devices of the invention.

An example of the cleaning devices relating to the invention will now be detailed by citing FIGS. 3 and 4. Wherein, toner guide roller 31 having at least the surface comprising an open-cell cellular material of the invention is incorporated into cleaning case 25 attached to frame member 33 of roller-supporting unit 30 and is then brought into contact with the circumferential surface of photoreceptor drum 20 so that the roller 31 is driven to rotate counterclockwise.

Frame member 33 forms a pair of side wall members 33*a* in the laterally symmetrical positions. Roller 31 is made rotatable and, at the same time, it is supported to be made movable toward the circumferential surface of photoreceptor drum 20, when bearings 34 —which are set from outside in supporting shafts 31 provided each to the left and right ends of guide roller 31—are each inserted into longish holes 33*b*.

With bearings 34, the portions protruded to the outside of side wall members 33*a* of which the outer circumference forms a flange having a semicircular shaped groove. Each end of tension spring 35 is fixed to protrusion 33*c* of the front edge of each side wall member 33*a* and the tension spring 35 is rolled up to energize guide roller 31 along longish hole 33*b*. With bearing 34 and tension spring 35, guide roller 31 can be energized with a well-balance and symmetrically at the left and right ends.

Further, frame member 33 forms bent portion 33*d* on the rear edge so that scraper 32 can be fixedly attached thereto. When frame member 33 is attached to cleaning case 25 in the later-described procedures, the circumferential surface of guide roller 31 is positioned to be pushed backward by the circumferential surface of photoreceptor drum 20, and the leading edge of scraper 32 comprising an elastic plate such as a SUS plate, a phosphor bronze plate and a mylar plate is provided at such an angle that the leading edge thereof may come into pressure contact with the circumferential surface of guide roller 31 with a specific load without obstructing the rotation of guide roller 31.

In such a manner as mentioned above, roller 31 comes into pressure contact with photoreceptor 20 and it is driven to rotate. Cleaning blade 26 that can be pressure contacted with and separated from photoreceptor drum 20 by cam 27 provided to the downstream side of the roller rotation. Toner scraped off by the cleaning blade 26 is made adhered to and then scraped off from roller 31 by the scraper 32 and is finally the transported to toner collection member 23. The cleaning blade 26 can be brought into pressure contact with and can also be separated from photoreceptor drum 20 by rotating shaft 27 against the tension of spring 28.

In this case, toner guide roller 31 is brought into pressure contact with photoreceptor drum 20 with a linear load within the range of 0.5 to 50 g/cm and it is driven to rotate in a nip width within the range of 0.5 to 4.0 mm when bringing it into pressure contact therewith, so that the cleaned up toner scraped by cleaning blade 26 is made adhered to and then transported by toner guide roller 31 and the toner is readily peeled off by scraper 32 and the collected to toner collection member 23. The toner guide roller 31 is able to smoothly collect the cleaned up toner and is, besides, able to effectively remove paper dust.

Figure 5:
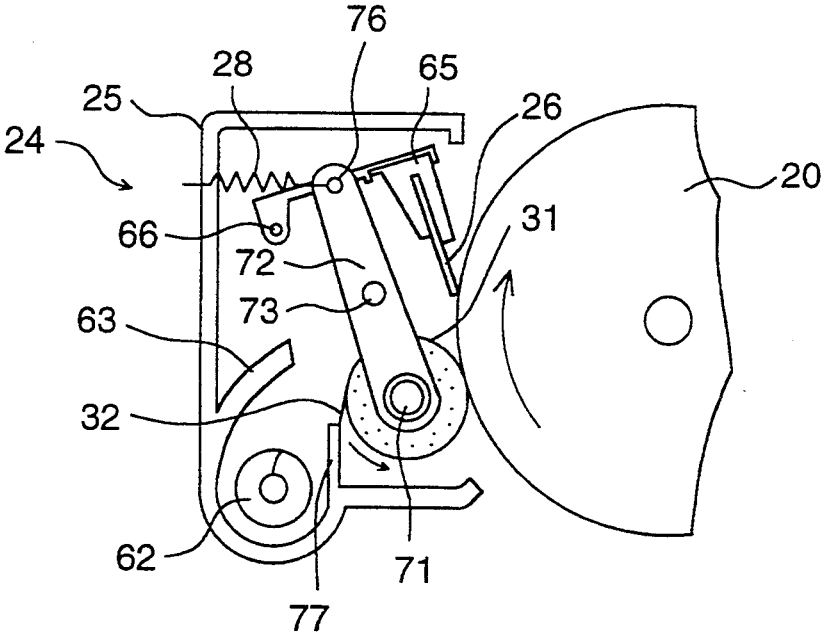
FIG. 5 is a cross-sectional view of a further example of the cleaning devices of the invention.

Now, another example of the cleaning devices relating to the invention will be detailed by citing FIG. 5 attached hereto. Wherein 20 is an organic photoreceptor drum rotating in the arrow direction. 24 is the cleaning device. In casing 25, there are the following two members incorporated compactly in a body, namely, cleaning blade 26 for scraping toner remaining on a photoreceptor and toner guide roller 31 for guiding cleaned up toner already scraped to toner collection member 32.

Holder 65 for blade 26 and toner guide roller 31 are each supported by shafts 76 and 71 at the both ends of arm 72 that is rotatable on shaft 73. The two members are so arranged as to be brought into pressure contact at the same time with a photoreceptor surface by the tension of tension spring 28 coupled to shaft 76. Guide roller 31 is supported by shaft 71 through a ball bearing and, therefore, arm 72 cannot interfere the rotation of guide roller 31.

Guide roller 31 is scrubbed by scraper 32 fixed to scraper support member 77 protruded to the lower inside of casing 25 and, thereby, cleaned up toner on guide roller 31 is collected in toner collection member 23.

Guide roller 31 comprises an open-cell cellular material having the structure shown in FIG. 1(*a*), that is excellent in cleaned up toner collection property.

As a toner guide roller specially selected from the toner guide rollers having the above-mentioned structure, this invention makes a proposal for a conductive toner guide roller shown in FIG. 1(*b*). In FIG. 1(*b*), (*b*) is a roll member comprising an open-cell cellular material provided to the outer circumference of core bar (*a*) and (*c*) is a conductive member dispersively contained in the roll member (*b*). Conductive members include, for example, conductive carbon, a metal powder and a metal oxide powder. The conductive carbon preferably used therein include, for example, KETJEN BLACK EC and KETJEN BLACK ECD J-600 each manufactured by Lion Co. OR Ketjen Black International Co., Vulcan XC-72 and Black Pearls 200 each manufactured by Cabot Co.

In a cleaning device, there are two operation steps, namely, a step in which toner remaining on an image-forming member is cleaned up by a cleaning blade and another step in which cleaned up toner is smoothly guided and then transported to a toner collection member by a toner guide roller. For carrying out each of the steps, it is essential that an image-forming member are not to be abraded or damaged. The above-mentioned remaining toner is usually electrostatically adsorbed to an image-forming member and is then thereby transported. Therefore, the conventional toner cleaning devices have been in danger of abrading or damaging an image-forming member, because the image-forming member is applied with an extra pressure by a cleaning blade.

In the invention, the toner guide roller is made conductive and roll member (b) shown in FIG. 1(*b*) is grounded through switching terminal (d), or roll member (b) is connected to electric power source (e) to apply roll member (b) with a DC and/or AC voltage having a polarity same with or opposite to the polarity of toner, so that the charge remaining on an image-forming member may be neutralized by bringing the guide roller into pressure contact with the image-forming member, thereby reducing the electrostatic adsorption of remaining toner to an image-forming member, enhancing the cleaning effect of a cleaning blade and enabling cleaning to perform with a relatively low contact pressure.

In the conductive toner guide roller of the invention, the conductivity $\sigma$ of roll member (b) shown in FIG. 1(*b*) is to be not lower than $10^{-9}\Omega^{-1}cm^{-1}$ and, preferably, within the range of $10^{-8}\Omega^{-1}cm^{-1}$ to $10^{-1}\Omega^{-1}cm^{-1}$. The carbon content thereof is, for example, within the range of 5 to 30 wt %. The guide roller may be in a floating state, a grounded state as indicated by (d) shown in FIG. 1(*b*) or a bias voltage applied state as indicated by (e) shown in FIG. 1(*b*). When the conductivity $\sigma$ of the guide roller is lower than $10^{-9}\Omega^{-1}cm^{-1}$, the conductibility of the guide roller is in short. Particularly when the guide roller is grounded, a charge remaining on an image-forming member is not satisfactorily grounded. When applying a bias voltage to the guide roller, the charge remaining on the image-forming member and toner cannot forcibly be neutralized.

The conductive toner guide roller shown in FIG. 1(*b*) can be incorporated in any one of the examples of the cleaning devices shown in shown in FIGS. 3 to 5. Thereby, an effective cleaning operation can be performed in association with a low contact type cleaning blade and, therefore, a high quality images can be formed repeatedly extending over a long period.

Among the image-forming processes and apparatuses each having the above-mentioned constitution in which such a peculiar toner guide roller (also including a conductive toner guide roller) as described above is used, an image-forming process and image-forming apparatus each using a specially selected image-forming member will now be detailed below.

A special feature of the image-forming member is that an organic photoreceptor is comprised of at least the surface layer containing polycarbonate or a copolymer containing a component unit of the polycarbonate so as to serve as a binder resin.

Figure 6:
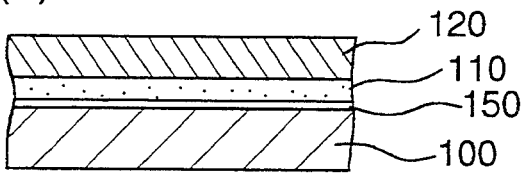
FIGS. 6(*a*) to 6(*f*) are cross-sectional views of an example of the layer arrangements of a photoreceptor of the invention; and is an illustration explaining operations of the Asuka C test for testing the hardness of an object.
Figure 6:
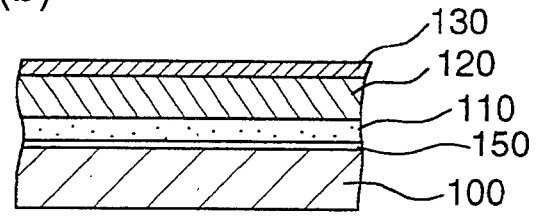
Figure 6:
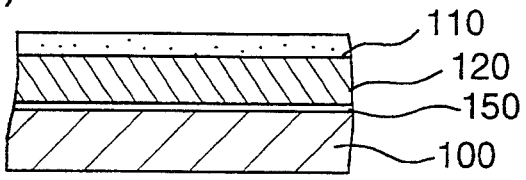
Figure 6:
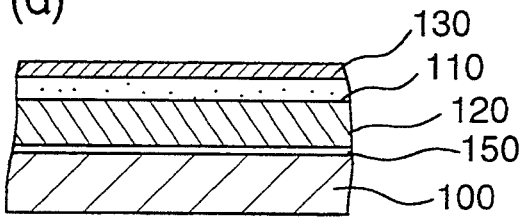
Figure 6:
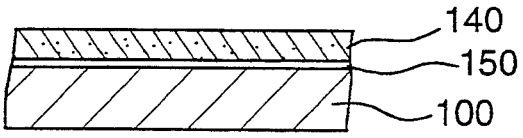
Figure 6:
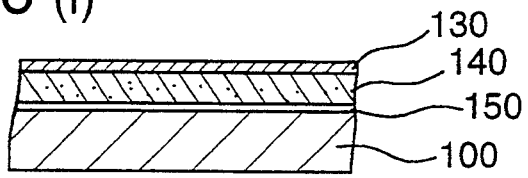
Figure 7A:
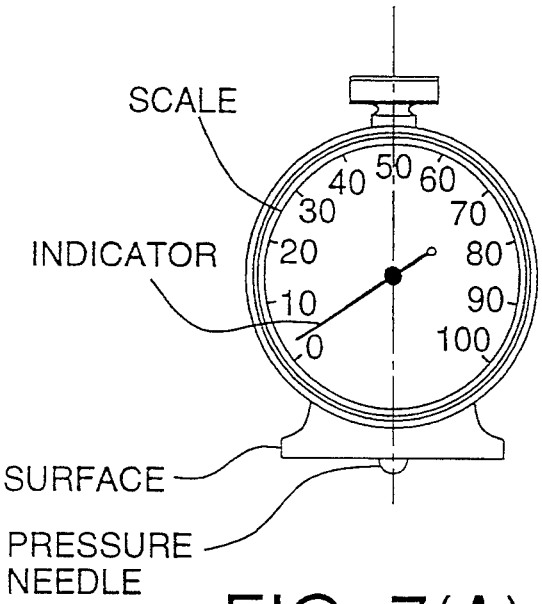
Figure 7B:
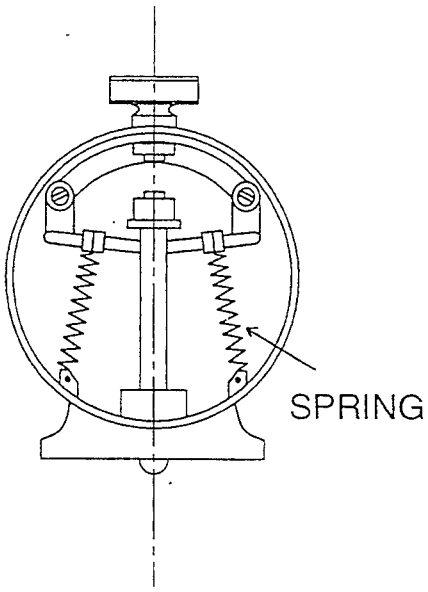
Figure 7C:
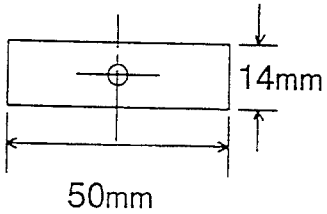
Figure 7D:
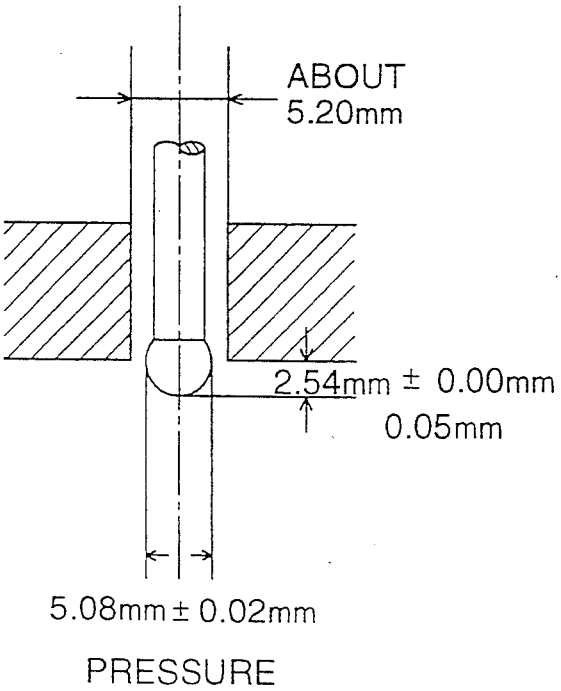

The layer arrangements of the organic photoreceptor are shown in FIGS. 6(*a*) through 6(*f*). Wherein 100 is a conductive support, 110 is a charge generation layer (CGL) containing a charge generation material (CGM), 120 is a charge transport layer (CTL) containing a charge transport material (CTM), 130 is a protective layer (OCL), 140 is a photoreceptive layer containing both CGM and CTM, and 150 is an interlayer having the functions of inhibiting a charge passing from the support to the photoreceptive layer and, besides, controlling an image quality.

Interlayer 150 is so formed as to have a thickness within the range of 0.01 to 2 $\mu$m either in a process of dip-coating or spray-coating a binder resin used in the photoreceptive layer and an organic polymer compound such as polyamide resin, polyvinyl alcohol, ethyl cellulose, carboxymethyl cellulose, casein and starch, or in another process of vacuum-evaporating or spattering aluminum oxide or the like.

In the case of the photoreceptor shown in FIG. 6(*e*), it is prepared by coating, on interlayer 150 provided to support 100, and processing a photoreceptive layer containing CGM in an amount of 5 to 100 parts by weight and CTM in an amount of 0 to 200 parts by weight each to 100 parts by weight of a binder resin so that the dried layer thickness thereof can be within the range of 5 to 30 $\mu$m.

The photoreceptor shown in FIG. 6(*f*) is prepared by coating protective layer 130 having a thickness within the range of 0.1 to 10 $\mu$m on the photoreceptive layer shown in FIG. 6(*e*).

In the case of the photoreceptor shown in FIG. 6(*a*), it is prepared by providing interlayer 150 thereon with CGL 110 having a dried thickness of 0.05 to 5 $\mu$m and containing CGM in an amount of 50 to 2000 parts by weight to 100 parts by weight of a binder resin and CTM in an amount of 0 to 200 parts by weight thereto and, further, providing CGL thereon with CTL 120 having a dried thickness of 5 to 40 $\mu$m and containing CTM in an amount of 30 to 200 parts by weight.

FIG. 6(*b*) illustrates a photoreceptor providing the CTL shown in FIG. 6(*a*) with a protective layer 130 having a thickness of 0.1 to 10 μm thereon.

In the case of FIG. 6(*c*), it is prepared by providing interlayer 150 thereon with CTL 120 having a dried thickness of 5 to 40 μm and containing CTM in an amount of 30 to 300 parts by weight to 100 parts by weight of a binder resin and, on the CTL, further providing CGL 110 having a dried thickness of 1 to 10 μm and containing CTM in an amount of 0 to 200 parts by weight.

The photoreceptor shown in FIG. (*d*) is prepared by providing CTL shown in FIG. 6(*c*) with CGL having a dried thickness of 0.05 to 5 μm and containing CGM in an amount of 50 to 2000 parts by weight per 100 parts of binder resin and CTM in an amount of 0 to 200 parts by weight thereon and then providing further a protective layer 130 having a thickness of 0.1 to 10 μm thereon.

CGL 110 for generating a carrier can be formed by dissolving or dispersing a variety of the following well-known CGM in a solvent together with a suitably binder resin and then by coating the resulting emulsion. The CGM include, for example; an azo type dye such as those of monoazo, bisazo and trisazo; a perylene type dye such as perylenic acid anhydride and perylenimide; an indigo type dye such as indigo and thioindigo; a polycycloquinone such as anthraquinone, pyrenequinone and flavanthrone; a quinacridone type dye; a bisbenzoimidazole type dye; an indathrone type dye; a squarylium type dye; a phthalocyanine type pigment such as a metal phthalocyanine and a non-metal phthalocyanine; and an eutectic complex formed of a pyrylium salt dye or a thiapyrilium salt dye and polycarbonate.

CTL 120 for transporting a carrier can be formed by dissolving or dispersing the following CTM together with a suitable binder in a solvent. The CTMs include, for example, a compound having a principal chain or a side chain containing a polycyclic aromatic compound such as anthracene, pyrene, phenanthrene and coronene; a compound having a nitrogen-containing aromatic ring, such as indole, carbazole, oxazole, isooxazole, thiazole, triazole, indazole, pyrazole, oxadiazole and pyrazoline; and a compound having a triphenylamine skelton, a stilbene skelton and a hydrazone skelton.

In the organic photoreceptor, the uppermost layer at least constituting the photoreceptive layer thereof contains, as the principal component, a copolymer containing polycarbonate or the component unit of polycarbonate for serving as a binder resin. It is also allowed that the uppermost layer contains, for example, the following resins, together with the above-mentioned binder resin; namely, polyester, polyethylene, polyamide, polystyrene, polyvinyl butyral, polymethacrylate, epoxy and polyvinyl carbazole. In the binder resins to be contained in the uppermost layer, the components of the other resin to be copolymerized with the polycarbonate component unit, or the other resin to be mixed with polycarbonate is to be added in an amount of less than 50% by weight to the amount of the binder resin used therein.

As for the polycarbonate applied to at least the uppermost layer of the organic photoreceptor, those represented by the following formulas ($B_1$) and/or ($B_2$) may be used.

Formula ($B_1$)

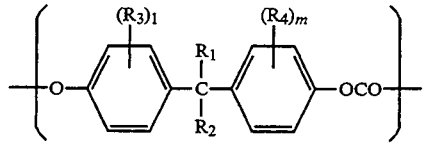

wherein $R_1$ and $R_2$ represent each a hydrogen atom, a substituted or unsubstituted alkyl group having 1 to 6 carbon atoms, or a substituted or unsubstituted aryl group; $R_3$ and $R_4$ represent each a hydrogen atom, a halogen atom, a substituted or unsubstituted alkyl group having 1 to 6 carbon atoms, or a substituted or unsubstituted aryl group; and l and m are each an integer of 1 to 4; provided, $R_1$ and $R_2$ may also be coupled to each other so as to form a hydrocarbon ring having 4 to 10 carbon atoms.

Formula ($B_2$)

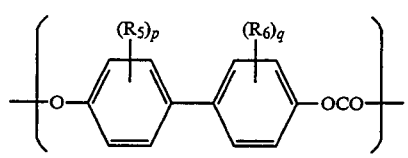

wherein $R_5$ and $R_6$ represent each a hydrogen atom, a halogen atom, a substituted or unsubstituted alkyl group having 1 to 6 carbon atoms, or a substituted or unsubstituted aryl group; and p and q are each an integer of 1 to 4.

The typical examples of the compounds represented by the above-given Formula ($B_1$) include those given below. However, the invention shall not be limited thereto.

$B_1$-1

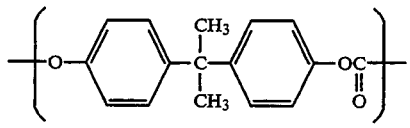

$B_1$-2

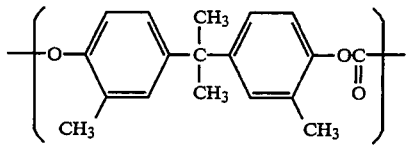

$B_1$-3

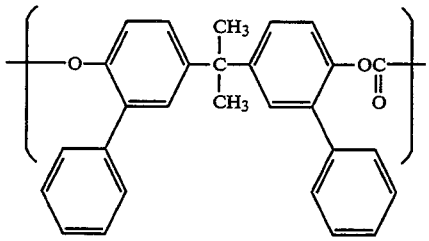

-continued
$B_1$-4
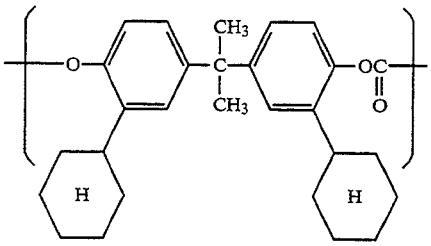
$B_1$-5
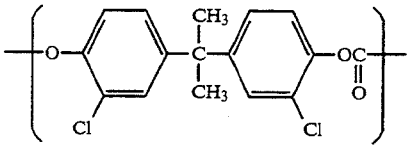
$B_1$-6
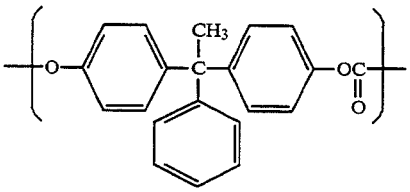
$B_1$-7
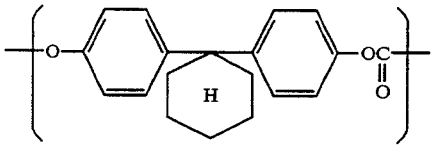
$B_1$-8
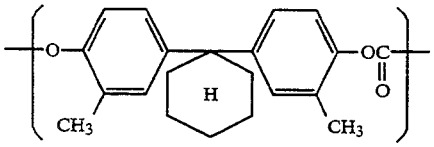
$B_1$-9
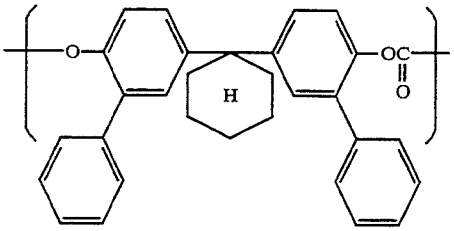
$B_1$-10
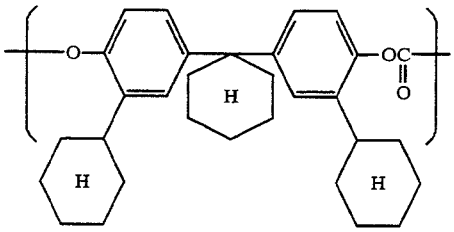
$B_1$-11
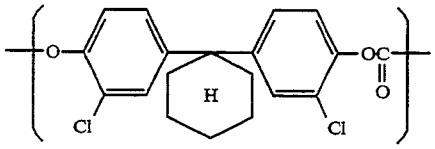
-continued
$B_1$-12
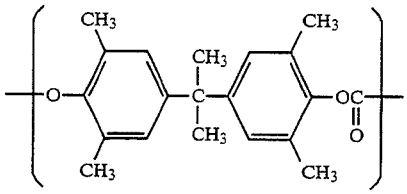
$B_1$-13
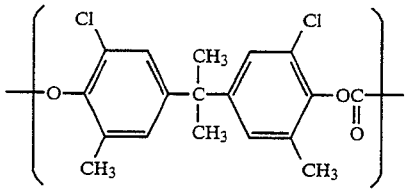
$B_1$-14
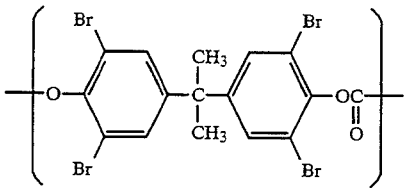
$B_1$-15
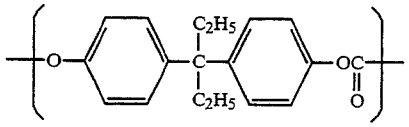
$B_1$-16
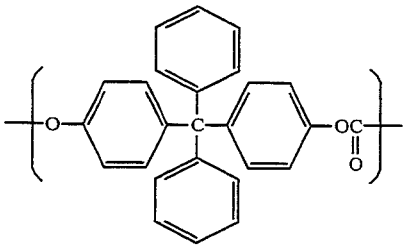
The typical examples of the compounds represented by the above-given Formula ($B_2$) include those given below. However, the invention shall not be limited thereto.
$B_2$-1
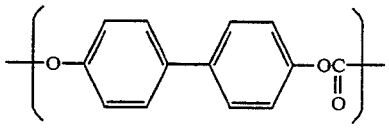
$B_2$-2
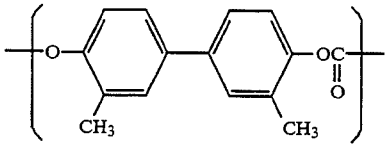

-continued $B_2$-3

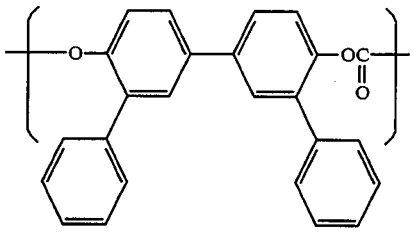

$B_2$-4

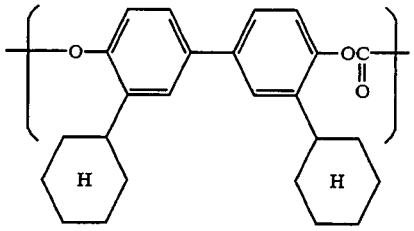

$B_2$-5

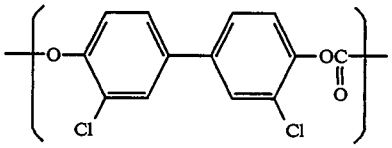

The polycarbonate component units represented by the above-given Formula ($B_1$) or ($B_2$) are each allowed to form a copolymer or also allowed to be polymerized with the component unit of other resin. As described above, in the case that an organic photoreceptor is used, as an image-forming member, of which at least the surface layer thereof contains polycarbonate or the copolymer thereof as the principal component of the binder resin, that the image-forming member is incorporated into an image-forming apparatus provided with the peculiar cleaning device shown either in FIG. 4 or in FIG. 5, and that an image is formed in the foregoing process, the cleaning property can more be improved and, at the same time, the abrasion and damage of the organic photoreceptor can remarkably be reduced. Therefore, when images are repeatedly formed any number of times, such an advantage can be enjoyed to obtain many high quality images stably extending over a long period.

EXAMPLES

This invention will now be detailed by citing the examples thereof. However, the embodiments of the invention shall not be limited thereto.

Example 1

An aluminum drum base having an outer diameter ∅ of 80 mm was provided thereon with an about 0.1 μm-thick interlayer comprising polyamide resin"DAIAMID X1874M" (manufactured by DAICEL-HÜLS LTD.).

A solution was prepared by dissolving 60 g of a pigment having the following chemical structure as CGM and 24 g of polyvinyl butyral resin"Eslec BX-1" (manufactured by Sekisui Chemical Industries Co.) in 3000 ml of 3-methyl-2-butanone. The solution was then dispersed in a sand mill for 10 hours. The resulting dispersion was dip-coated on the interlayer and then dried well, so that CGL having a thickness of about 0.3 μm.

On the other hand, a solution was prepared by dissolving 340 g of CTM having the following chemical structure and 450 g of binder resin"Panlite K-1300" (manufactured by Teijin Chemical Industries Co.) in 3000 ml of 1,2-dichloroethane. The resulting solution was dip-coated on the CGL and dried up at 80° C. for one hour to form a 20 μm-thick CTL, so that a photoreceptor subject to the test for the example could be obtained.

Structure of CGM:

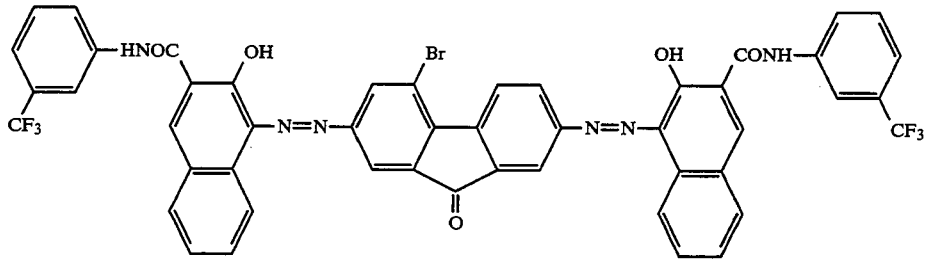

Structure of CTM:

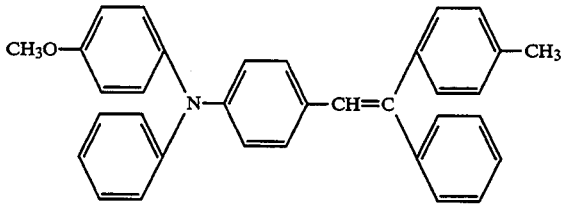

By making use of a modified U-Bix 4045 copying machine incorporated with a photoreceptor and a toner guide roller having the structure shown in FIG. 1(*a*) and comprising an open-cell cellular material or a closed-cell cellular material, such as polyurethane, an image forming test was tried in the following procedures.

As for the tests of the invention, there used the toner guide rollers comprising 7 kinds of open-cell cellular materials as shown in Table 1. As for the comparison to the invention, there used 3 kinds of closed-cell cellular materials shown in Table 1. And, the cleaning blade was so arranged to bring it into hit-contact, in a counter system, with the photoreceptor, and the contact load thereof was so set as to be 15.5 g-f/cm. On the other hand, the toner guide roller was so driven to be rotated by the photoreceptor and the contact load thereof was so set to be 40.0-f/cm. Then, a series of 100,000 times copying tests was tried at 60% RH and 20° C.

After trying the tests, the following five properties were measured and evaluated. The results thereof will be shown in Table 2.

(1) Procedures for measuring the driven rotation of the toner guide roller

The circumferential revolution velocity Vpc (mm/sec.) of the photoreceptor drum and the circumferential revolution velocity $V_R$ (mm/sec.) relating to Vpc were each measured. The resulting driven rotatability was indicated by $V_R$/VpC.

(2) Procedures for measuring the toner scattering of the roller and the evaluation of the toner scattering.

After completing the 10,000 times copying test, the black spots produced in a copied white image by toner scattering were judged with the eye.

The resulting evaluations were graded as follows;

a) Graded by ⊖ when no black spot was produced at all;

b) Graded by ○ when not more than 5 black spots having a size of not smaller than 0.5 mm; and c) Graded by X when 5 or more black spots were produced or 1 or more black spots having a size of larger than 0.5 mm.

(3) Procedures for measuring the damages (Rmax) of the tested photoreceptor

By making use of a surface roughness tester, Surfcorder SE-30H (manufactured by Kosaka Labs.), the surface roughness of the photoreceptor was measured after completing a 100,000 times copying tests, and the result thereof was indicated by Rmax.

(4) Procedures for measuring the abrasion (μm) of the photoreceptor

By making use of a layer thickness tester of the eddy current type, the layer thickness abrasion of the photoreceptor produced after completing a 100,000 times copying test was measured and the results thereof was indicated by a μm unit.

(5) Procedures for measuring the halftone image quality and the evaluation thereof After completing the 100,000th copy, the streaks and density unevenness produced by the abrasion of the density of 0.2 to 0.4 were judged with the eye and the results thereof were graded as follows;

a) Graded by ⊖ when the result came out excellent without producing any black streak nor density unevennness, b) Graded by ○ when the result came out excellent but with a few black spots and density unevenness;

c) Graded by X when the practical applicability is poor, because there were density unevenness and black spots; and d) Graded by XX when unqualified at all, because the black streaks and density unevenness were seriously apparent.

TABLE 1

| Roller No. | Kind of Guide Roller | Porosity | Pore size | Specific gravity | Asuka C hardness |
|---|---|---|---|---|---|
| | Property | | | | |
| For Invention Test | | | | | |
| 1 | Open-cell cellular polyurethane | 90% | 10 μm | 0.23 | 20° |
| 2 | Open-cell cellular polyurethane | 80% | 10 μm | 0.25 | 27° |
| 3 | Open-cell cellular polyurethane | 60% | 10 μm | 0.31 | 40° |
| 4 | Open-cell cellular polyurethane | 80% | 10 μm | 0.31 | 71° |
| 5 | Open-cell cellular polyurethane | 90% | 10 μm | 0.21 | 13° |
| 6 | Open-cell cellular chloropylene | 80% | 15 μm | 0.32 | 33° |
| 7 | Open-cell cellular chloropylene | 60% | 20 μm | 0.30 | 45° |
| For Comparison Test | | | | | |
| 8 | Closed-cell foamed polyurethane | 40% | 75 μm | 0.52 | 40° |
| 9 | Closed-cell foamed chloropylene | 50% | 80 μm | 0.42 | 33° |
| 10 | Closed-cell foamed silicone | 40% | 100 μm | 0.55 | 45° |

TABLE 2

| Test No. | Roller No. | Driven roller rotation | Toner scatter from roller | Photoreceptor damage (Rmax) | Photoreceptor abrasion | Halftone image quality |
|---|---|---|---|---|---|---|
| | Property | | | | | |
| Invention Test | | | | | | |
| 1 | 1 | 0.95 | ⊖ | 0.3 μm | 3.2 μm | ⊖ |
| 2 | 2 | 0.93 | ⊖ | 0.3 μm | 3.5 μm | ⊖ |
| 3 | 3 | 0.94 | ⊖ | 0.4 μm | 4.1 μm | ⊖ |
| 4 | 4 | 0.90 | ○ | 0.8 μm | 4.2 μm | ○ |
| 5 | 5 | 0.81 | ○ | 0.5 μm | 3.5 μm | ○ |
| 6 | 6 | 0.92 | ○ | 0.6 μm | 4.0 μm | ○ |
| 7 | 7 | 0.90 | ○ | 0.5 μm | 4.1 μm | ○ |
| Comparison Test | | | | | | |
| 1 | 8 | 0.62 | X | 5.2 μm | 6.5 μm | XX |
| 2 | 9 | 0.71 | X | 4.2 μm | 5.5 μm | X |
| 3 | 10 | 0.72 | X | 3.6 μm | 5.9 μm | X |

From the contents of Table 2, the invention tests prove that every one of the roller driven property, toner scattering from a roller, damages of a photoreceptor, abrasion of a photoreceptor, halftone image quality and so forth came out excellent and, however, the comparison tests to the invention prove that every one of the above-mentioned five properties are so poor that any practical applicability cannot be obtained.

Separate from the above-mentioned tests, a 50,000 times copying test was tried under the conditions of a high temperature of 33° C. and a high humidity of 80% RH. As the results therefrom, the tests for which a guide roller of the invention proved each that an image smear produced by paper dust was not found out and, on the other hand, the tests for which a guide roller for comparison use proved each that such an image smear as mentioned above was seriously found out.

Example 2

By making use of a modified U-Bix 4045 copying machine incorporated with the photoreceptor used in Example 1 and a toner guide roller having the structure shown in FIG. 1(*b*) and comprising an open-cell cellular material or a closed-cell cellular material, an image forming test was tried in the following procedures.

Continuous 100,000 times copying tests were each tried under the same conditions and procedures as in Example 1, except that, in the tests of the invention, there used the toner guide rollers comprising 5 kinds of conductive or non-conductive open-cell cellular materials shown in Table 3, that, in the comparison to the invention, there used 2 kinds of closed-cell cellular materials shown in Table 3, and that the guide rollers made conductive were applied with a bias voltage or were grounded.

By taking the contact pressure reduction of a cleaning blade into consideration, that is obtained by making the toner guide roller conductive and by applying a DC current or a sine-wave formed AC bias voltage to the rollers or by grounding the rollers, the tests were tried of the example. To be more concrete, the hit-contact load of the cleaning blade was varied and the resulting variations of the damage and abrasion of the photoreceptors were measured and then the halftone image qualities were evaluated. The results thereof will be shown in Table 4. The procedures of the measurements and evaluations were the same as in Example 1.

TABLE 3

| Roller No. | Guide roller | Property: Porosity | Pore size | Specific gravity | Asuka C hardness | Conductivity |
|---|---|---|---|---|---|---|
| For invention test | | | | | | |
| 1 | Open-sell cellular polyurethane | 80% | 25 μm | 0.28 | 30° | $10^{-5}\Omega^{-1}cm^{-1}$ |
| 2 | Open-sell cellular polyurethane | 75% | 20 μm | 0.30 | 33° | $10^{-8}\Omega^{-1}cm^{-1}$ |
| 3 | Open-sell cellular polyurethane | 78% | 15 μm | 0.28 | 30° | $10^{-9}\Omega^{-1}cm^{-1}$ |
| 4 | Open-sell cellular polyurethane | 80% | 16 μm | 0.29 | 27° | $10^{-10}\Omega^{-1}cm^{-1}$ |
| 5 | Open-sell cellular polyurethane | 80% | 10 μm | 0.25 | 27° | $10^{-14}\Omega^{-1}cm^{-1}$ |
| 6 | Open-sell cellular chloropylene | 80% | 15 μm | 0.32 | 33° | $10^{-8}\Omega^{-1}cm^{-1}$ |
| For comparison test | | | | | | |
| 7 | Closed-cell foamed polyurethane | 50% | 78 μm | 0.51 | 40° | $10^{-8}\Omega^{-1}cm^{-1}$ |
| 8 | Closed-cell foamed polyurethane | 48% | 80 μm | 0.50 | 38° | $10^{-14}\Omega^{-1}cm^{-1}$ |

TABLE 4

| Test No. | Roller No. | Roller boas: $V_{AC}$ | Roller boas: $V_{DC}$ | Photo-receptor damage (Rmax) | Cleaning blade hit-contact load | Photo-receptor abrasion | Halftone image quality |
|---|---|---|---|---|---|---|---|
| Invention test | | | | | | | |
| 1 | 1 | 1 KHz Sine wave $V_{p-p}$1 KV | +100 V | 0.3 μm | 10.0 g-f/cm | 2.4 μm | ⊙ |
| 2 | 2 | 1 KHz Sine wave $V_{p-p}$1 KV | +100 V | 0.4 μm | 11.2 g-f/cm | 2.8 μm | ⊙ |
| 3 | 3 | 1 KHz Sine wave $V_{p-p}$1 KV | +100 V | 0.4 μm | 12.0 g-f/cm | 2.8 μm | ⊙ |
| 4 | 4 | 1 KHz Sine wave $V_{p-p}$1 KV | +100 V | 0.4 μm | 14.9 g-f/cm | 3.4 μm | ○ |
| 5 | 5 | 1 KHz Sine wave $V_{p-p}$1 KV | +100 V | 0.6 μm | 15.5 g-f/cm | 3.6 μm | ○ |
| 6 | 6 | 1 KHz Sine wave $V_{p-p}$1 KV | +100 V | 0.4 μm | 12.1 g-f/cm | 3.0 μm | ⊙ |
| 7 | 1 | Ground | Ground | 0.4 μm | 12.5 g-f/cm | 2.9 μm | ⊙ |
| Comparison test | | | | | | | |
| 1 | 7 | 1 KHz | +100 V | 4.1 μm | 12.1 | 5.1 μm | X |

TABLE 4-continued

| Test No. | Roller No. | Roller boas $V_{AC}$ | Roller boas $V_{DC}$ | Photo-receptor damage (Rmax) | Cleaning blade hit-contact load | Photo-receptor abrasion | Halftone image quality |
|---|---|---|---|---|---|---|---|
| | | Property | | | | | |
| 2 | 8 | Sine wave $V_{p-p}$1 KV 1 KHz | +100 V | 5.2 μm | g-f/cm 15.5 g-f/cm | 6.7 μm | XX |
| 3 | 7 | Sine wave $V_{p-p}$1 KV Ground | Ground | 4.6 μm | 13.8 g-f/cm | 5.8 μm | X |

In Table 4, the hit-contact load of the guide roller to the photoreceptor was set to be 40.0 g-f/cm, the hit-contact load of the cleaning blade to the photoreceptor was so set as not to produce any cleaning error, that is, the minimum blade contact load of +1.0 g-f/cm.

From Table 4, the invention tests prove that the abrasion of the photoreceptive layers are reduced when completing every 100,000 times copying test and the halftone image qualities come out excellent, that, particularly when making the toner guide roller conductive, the hit-contact load of the cleaning blade to the photoreceptor can be reduced, so that the abrasion of the photoreceptive layer can be reduced as much, and that the durability of the photoreceptive layer can be increased thereby so as to obtain every excellent halftone quality image extending over a long period. In contrast to the above tests, the comparison tests prove that the abrasion of every photoreceptor is increased and the halftone image qualities become worse, so that no practical applicability can be obtained.

Example 3

Photoreceptors No. 1 through No. 3 were prepared in the same manner as in Example 1, except that the binder resins for CTL were each used, which were the resins each comprising an independent polymer having a viscosity average molecular weight of about 30,000 and also containing Exemplified Compound $B_1$-7, $B_1$-2 or $B_2$-1 as the component units.

The resin containing $B_1$-7 as the component unit is available on the market under the brand name of "IUPILON Z-300" (manufactured by Mitsubishi Gas-Chemical Co.)

Photoreceptor No. 4 was prepared in the same manner as in Example 1, except that the binder resin for CTL was used, which was a resin comprising a copolymer having a viscosity average molecular weight of about 39,000, which was copolymerized with Exemplified Compounds $B_1$-1 and $B_2$-1 in a proportion by weight of 80:20.

Photoreceptor No. 5 was prepared in the same manner as in Example 1, except that a binder resin for CTL was used, which was a resin comprising an independent polymer having a viscosity average molecular weight of about 30,000 and also containing the following compound as the component unit of the resin.

The chemical formula of the above-mentioned compound will be given below.

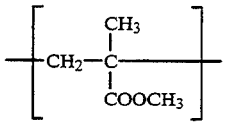

By making use of a modified U-Bix 4045 copying machine incorporated with each of the foregoing photoreceptor and each of the toner guide rollers given in Table 5, each of the practical 100,000 times copying tests shown in Table 6 was tried in the same manner as in Example 1. The five kinds of property measurements and the evaluations thereof were made as shown in Table 6 and the results thereof will also be shown in Table 6.

TABLE 5

| Roller No. | Kind of Guide Roller | Porosity | Pore size | Specific gravity | Asuka C hardness |
|---|---|---|---|---|---|
| | Property | | | | |
| For Invention Test | | | | | |
| 1 | Open-cell cellular polyurethane | 90% | 10 μm | 0.23 | 20° |
| 2 | Open-cell cellular polyurethane | 80% | 10 μm | 0.25 | 27° |
| 3 | Open-cell cellular polyurethane | 50% | 10 μm | 0.31 | 40° |
| 4 | Open-cell cellular chloropylene | 80% | 15 μm | 0.32 | 33° |
| For Comparison Test | | | | | |
| 5 | Closed-cell foamed polyurethane | 40% | 75 μm | 0.52 | 40° |
| 6 | Closed-cell foamed chloropylene | 50% | 80 μm | 0.42 | 33° |
| 7 | Closed-cell foamed silicone | 40% | 100 μm | 0.55 | 45° |

TABLE 6

| Test No. | Roller No. | Photo-receptor No. | Property: Property and Evaluation: Roller driven rotatability | Toner scattering from roller | Photo-receptor dame (Rmax) | Photo-receptor abrasion | Halftone image quality |
|---|---|---|---|---|---|---|---|
| Invention Test | | | | | | | |
| 1 | 1 | 1 | 0.98 | ◎ | 0.2 μm | 2.6 μm | ◎ |
| 2 | 2 | 1 | 0.96 | ◎ | 0.2 μm | 2.8 μm | ◎ |
| 3 | 3 | 1 | 0.92 | ◎ | 0.3 μm | 2.7 μm | ◎ |
| 4 | 4 | 1 | 0.93 | ◎ | 0.3 μm | 2.5 μm | ◎ |
| 5 | 2 | 2 | 0.97 | ◎ | 0.2 μm | 3.0 μm | ◎ |
| 6 | 2 | 3 | 0.92 | ◎ | 0.3 μm | 3.1 μm | ◎ |
| 7 | 2 | 4 | 0.93 | ◎ | 0.2 μm | 2.8 μm | ○ |
| Comparison Test | | | | | | | |
| 1 | 5 | 1 | 0.71 | X | 4.2 μm | 5.9 μm | X |
| 2 | 6 | 1 | 0.74 | X | 3.6 μm | 5.1 μm | X |
| 3 | 7 | 1 | 0.75 | X | 3.1 μm | 5.1 μm | X |
| 4 | 5 | 5 | 0.61 | X | 8.5 μm | 7.2 μm | XX |

From the contents of Table 6, the invention tests prove that the roller driven rotatability is excellent, the toner stain is reduced, the photoreceptor abrasion and damage are reduced to increase the high durability and the binder resin for CTL, i.e., the upper layer of the photoreceptor, is principally comprised of polycarbonate. Therefore, it can be understood that a high durability and a high image quality can be achieved thereby. In contrast thereto, the comparison tests prove that every photoreceptor is abraded and damaged seriously and the durability becomes poor.

According to a toner guide roller of the invention and the image-forming process and apparatus in which the guide roller is used, the following advantages can be enjoyed when forming images repeatedly in number of times. For example, toner remaining on a photoreceptor can be cleaned up without abrading and damaging the photoreceptor and the cleaned up toner can also smoothly be collected. Further, a high quality image can stably be obtained without any defects such as a black streak, density unevenness and toner stain.

Also, the following advantages can be enjoyed. For example, particularly when making a toner guide roller conductive, the contact pressure of a cleaning blade can be reduced and the durability of a photoreceptor can more be prolonged and, when the binder resin containing a photoreceptor surface layer is comprised of polycarbonate, the durability of the photoreceptor can further be prolonged.

What is claimed is:

1. An image forming apparatus for forming a toner image on a recording sheet, comprising:

a photoreceptor for holding the toner image;

means for forming a latent image on said photoreceptor;

means for developing said latent image with a toner so that said toner image is formed on a surface of said photoreceptor;

means for transferring said toner image from said surface of said photoreceptor to the recording sheet;

means for scraping off a residual toner on said surface of said photoreceptor after said toner image is transferred from said surface to said recording sheet;

means for collecting said residual toner;

a toner guide roller means for conveying said residual toner from said scraping means to said collecting means;

wherein said toner guide roller means is urged onto said surface of said photoreceptor, and said toner guide roller means has a surface made of an open-cell cellular material having a pore size between 1 μm and 50 μm.

2. The apparatus of claim 1, wherein a porosity of said open-cell cellular material is between 50% and 90%, and a specific gravity of said open-cell cellular material is between 0.1 and 0.4.

3. The apparatus of claim 1, wherein a hardness of said open-cell cellular material is between 15° and 50° in Asuka C hardness.

4. The apparatus of claim 1, wherein said scraping means and said toner guide roller means are uniformly integrated into a casing member.

5. The apparatus of claim 1, wherein said open-cell cellular material is conductive.

6. The apparatus of claim 5, wherein a porosity of said open-cell cellular material is between 50% and 90%, and a specific gravity of said open-cell cellular material is between 0.1 and 0.4.

7. The apparatus of claim 5, wherein a hardness of said open-cell cellular material is between 15° and 50° in Asuka C hardness.

8. The apparatus of claim 5, wherein a conductivity of said open-cell cellular material is not lower than $10^{-19}\Omega^{-1}cm^{-1}$.

9. The apparatus of claim 5, wherein said scraping means and said toner guide roller means are uniformly integrated into a casing member.

10. The apparatus of claim 1, wherein said photoreceptor is an organic photoreceptor which has at least a surface layer of a binder resin including a polycarbonate or a copolymer containing a component unit of said polycarbonate.

11. The apparatus of claim 10, wherein said polycarbonate or a copolymer containing a component unit of said polycarbonate is represented by following formula ($B_1$) or ($B_2$).

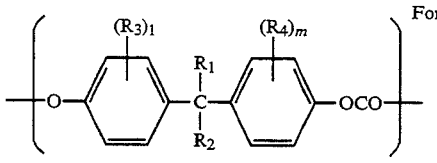

Formula ($B_1$)

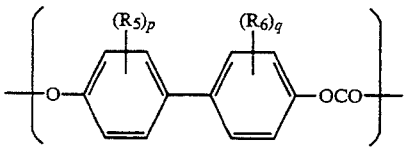

Formula ($B_2$)

12. The apparatus of claim 11, wherein a porosity of said open-cell cellular material is between 50% and 90%, and a specific gravity of said open-cell cellular material is between 0.1 and 0.4.

13. The apparatus of claim 11, wherein a hardness of said open-cell cellular material is between 15° and 50° in Asuka C hardness.

14. The apparatus of claim 11, wherein said scraping means and said toner guide roller means are uniformly integrated into a casing member.

15. The apparatus of claim 11, wherein said open-cell cellular material is conductive.

16. The apparatus of claim 15, wherein a porosity of said open-cell cellular material is between 50% and 90%, and a specific gravity of said open-cell cellular material is between 0.1 and 0.4.

17. The apparatus of claim 15, wherein a hardness of said open-cell cellular material is between 15° and 50° in Asuka C hardness.

18. The apparatus of claim 15, wherein a conductivity of said open-cell cellular material is not lower than $10^{-19}\Omega^{-1}cm^{1}$.

19. The apparatus of claim 15, wherein said scraping means and said toner guide roller means are uniformly integrated into a casing member.

* * * * *